US005829660A

United States Patent [19]

White

[11] Patent Number: 5,829,660

[45] Date of Patent: Nov. 3, 1998

[54] AUTOMATIC-TYPE FASTENER DRIVING DEVICE

[75] Inventor: Brian M. White, Riverside, R.I.

[73] Assignee: Stanley-Bostitch, Inc., East Greenwich, R.I.

[21] Appl. No.: 568,539

[22] Filed: Dec. 7, 1995

[51] Int. Cl.[6] ..... B25C 1/04

[52] U.S. Cl. ..... 227/8; 227/130

[58] Field of Search ..... 227/8, 119, 120, 227/130

[56] References Cited

U.S. PATENT DOCUMENTS

| | | | |
|---|---|---|---|
| 3,353,453 | 11/1967 | Ramspeck | 227/130 |
| 3,567,098 | 3/1971 | Maynard | 227/130 |
| 3,771,710 | 11/1973 | Perkins | 227/130 |
| 4,211,352 | 7/1980 | Zilka | 227/130 |
| 4,344,555 | 8/1982 | Wolfberg | 227/130 |
| 4,550,643 | 11/1985 | Schwartzenberger | 227/8 |
| 4,784,308 | 11/1988 | Novak et al. | 227/130 |
| 4,915,013 | 4/1990 | Moraht et al. | 227/130 |
| 5,014,898 | 5/1991 | Heidrich | 227/130 |
| 5,046,653 | 9/1991 | Uno | 227/130 |
| 5,135,152 | 8/1992 | Uno et al. | 227/130 |
| 5,485,946 | 1/1996 | Jankel | 227/8 |
| 5,522,532 | 6/1996 | Chen | 227/8 |
| 5,628,444 | 5/1997 | White | 227/130 |

FOREIGN PATENT DOCUMENTS

| | | |
|---|---|---|
| 0 034 372 | 2/1981 | European Pat. Off. . |
| 0 326 639 | 7/1988 | European Pat. Off. . |
| 3341980 A1 | 7/1985 | Germany . |

*Primary Examiner*—Scott A. Smith

*Attorney, Agent, or Firm*—Cushman, Darby & Cushman, IP Group of Pillsbury, Madison & Sutro LLP

[57] ABSTRACT

A pneumatically operated fastener driving device includes a pilot pressure operated main valve movable from a normally closed position into an opened position allowing a supply of air under pressure to be communicated with a piston chamber to initiate and effect the movement of a piston and fastener driving element through a fastener drive stroke. A first passage structure communicates a pilot pressure chamber and an exhaust port. A secondary valve member is mounted with respect to the first passage structure so as to be movable between an opened position permitting communication between the pilot pressure chamber and the exhaust port and a closed position preventing such communication. A second passage structure communicates the piston chamber with the secondary valve member. An operative cycle is initiated upon exhausting pilot pressure in the pilot pressure chamber causing the main valve to move to its opened position thereby initiating the fastener drive stroke. A build-up of pressure over the drive piston in the piston chamber communicates with the secondary valve member moving it to its closed position thereby preventing communication between the pilot pressure chamber and the exhaust port and causing the main valve to move to its closed position. The secondary valve member is constructed and arranged to move in response to changes in air pressure over the drive piston occurring in the piston chamber to cause the main valve to reciprocate thereby causing the drive piston to move through repeated operating cycles as long as the trigger member is in its operative position.

24 Claims, 12 Drawing Sheets

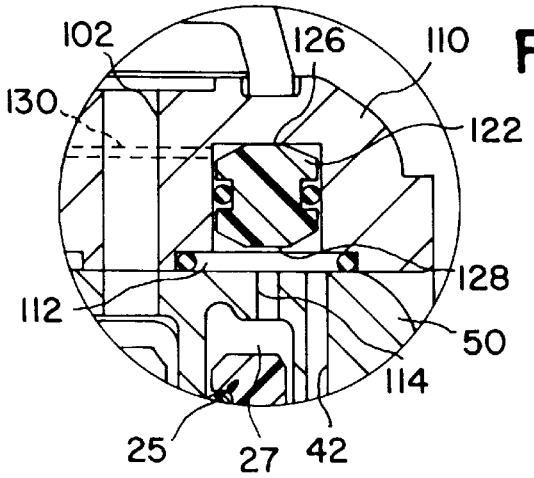
FIG. 4
FIG. 5
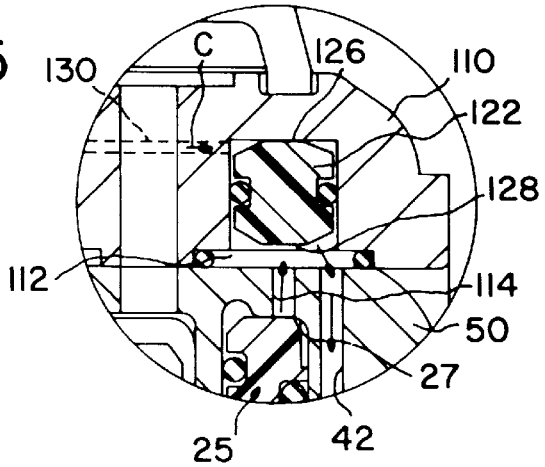
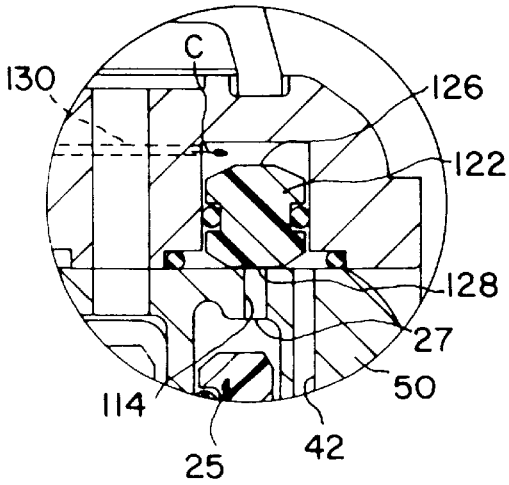
FIG. 6

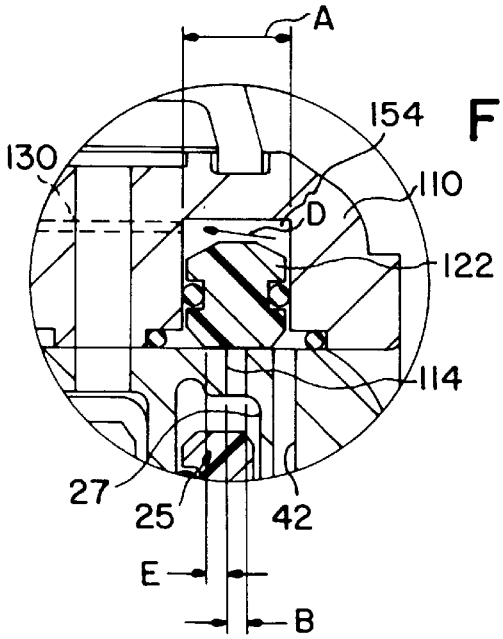
FIG. 7
FIG. 8
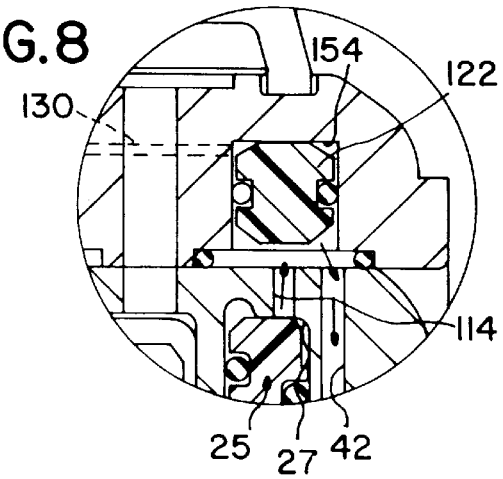
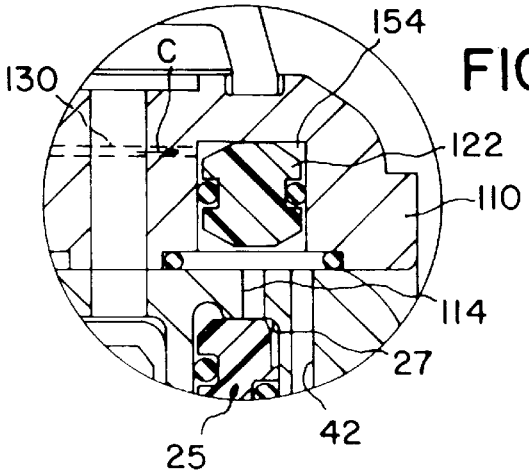
FIG. 9

AUTOMATIC-TYPE FASTENER DRIVING DEVICE

BACKGROUND OF THE INVENTION

This invention relates to a fastener driving device and, more particularly, to an air operated fastener driving device having a main valve and a secondary valve member permitting the device to operate in an automatic mode.

Conventional fastener driving devices typically include a pilot pressure operated main valve movable from a closed position to an opened position permitting air under pressure to communicate with a piston chamber for moving a piston and fastener driving element, thereby initiating a fastener drive stroke. To operate the driving device in an automatic mode of operation, a pressure responsive secondary valve is typically provided. With this arrangement, when a manually operable trigger is actuated and held, the main valve and the secondary valve operate alternately to intake air into the piston chamber and subsequently discharge the air therefrom, so that the movement of the piston and fastener driving element is repeated. There is always a need to provide an automatic-type fastener driving device with an improved valve arrangement which is cost effective and easy to assemble.

SUMMARY OF THE INVENTION

An object of the present invention is to fulfill the need described above. In accordance with the principles of the present invention, this objective is accomplished by providing a pneumatically operated fastener driving device comprising a housing assembly including a cylinder therein, the housing assembly defining a fastener drive track. A drive piston is slidably sealingly mounted in the cylinder for movement through an operative cycle including a drive stroke and a return stroke. A fastener driving element is operatively connected to the piston and mounted in the fastener drive track for movement therein through a drive stroke in response to the drive stroke of the piston and a return stroke in response to the return stroke of the piston. A fastener magazine assembly is carried by the housing assembly for feeding successive fasteners laterally into the drive track to be driven therefrom by the fastener driving element during the drive stroke thereof. A piston chamber is defined at one end of the cylinder and communicates with the drive piston. An air pressure reservoir communicates with the piston chamber. An exhaust path defined in the housing assembly communicates the piston chamber with the atmosphere when the exhaust path is in an opened condition. A pilot pressure operated main valve is movable from a normally closed position into an opened position closing the exhaust path and allowing a supply of air under pressure from the air pressure reservoir to be communicated with the piston chamber to initiate and effect the movement of the piston and fastener driving element through the fastener drive stroke thereof. The main valve has a first pressure area defining with a portion of the housing assembly a pilot pressure chamber, and a second pressure area in opposing relation to the first pressure area and exposed to the supply of air under pressure. A feed orifice communicates the air pressure reservoir with the pilot pressure chamber. An actuator is mounted for movement with respect to an exhaust port for controlling pressure in the pilot pressure chamber. The actuator is (1) normally disposed in an inoperative position closing the exhaust port such that pressure within the air pressure reservoir may communicate with the pilot pressure chamber as pilot pressure therein, and (2) movable in response to a manual actuating procedure into an operating position opening the exhaust port and exhausting the pilot pressure in the pilot pressure chamber through the exhaust port to atmosphere. A trigger member is mounted with respect to the housing assembly for manual movement from a normal, inoperative position to an operative position for moving the actuator to its operating position. First passage structure is provided between the pilot pressure chamber and the exhaust port.

A secondary valve member is mounted with respect to the first passage structure so as to be movable between an opened position permitting communication between the pilot pressure chamber and the exhaust port and a closed position preventing communication between the pilot pressure chamber and the exhaust port. The second passage structure communicates the piston chamber with the secondary valve member. An operative cycle is initiated upon movement of the trigger member to its operative position which moves the actuator to its operating position exhausting pilot pressure in the pilot pressure chamber and causing the main valve to move to its opened position thereby initiating the fastener drive stroke. Pressure over the drive piston in the piston chamber communicates with the secondary valve member to move the secondary valve member to its closed position preventing communication between the pilot pressure chamber and the exhaust port thereby causing the main valve to move to its closed position. The secondary valve member is constructed and arranged to move in response to changes in pressure occurring in the piston chamber to cause the main valve to reciprocate thereby causing the drive piston to move through repeated operating cycles as long as the trigger member is in its operative position.

BRIEF DESCRIPTION OF THE DRAWINGS

FIG. 4 is an enlarged view of the area enclosed by circle A of FIG. 2, showing a secondary valve member in an opened position and a main valve in a closed position, when the device is at rest;

FIG. 5 is a view similar to FIG. 4, showing the main valve moved to an opened position initiating the drive stroke of the piston;

FIG. 6 is a view similar to FIG. 4, showing the main valve and the secondary valve member in closed positions during the return stroke of the piston;

FIG. 7 is a view similar to FIG. 6, showing over-the-piston pressure in a shuttle cavity bleeding to low pressure during the return stroke of the piston;

FIG. 8 is a view similar to FIG. 4, showing the main valve and secondary valve member in opened positions during the piston drive stroke, when over-the-piston pressure is at low pressure; and FIG. 9 is a view similar to FIG. 8, showing the main valve and shuttle valve in opened positions during the piston drive stroke, as over-the-piston pressure becomes high pressure.

Figure 1:
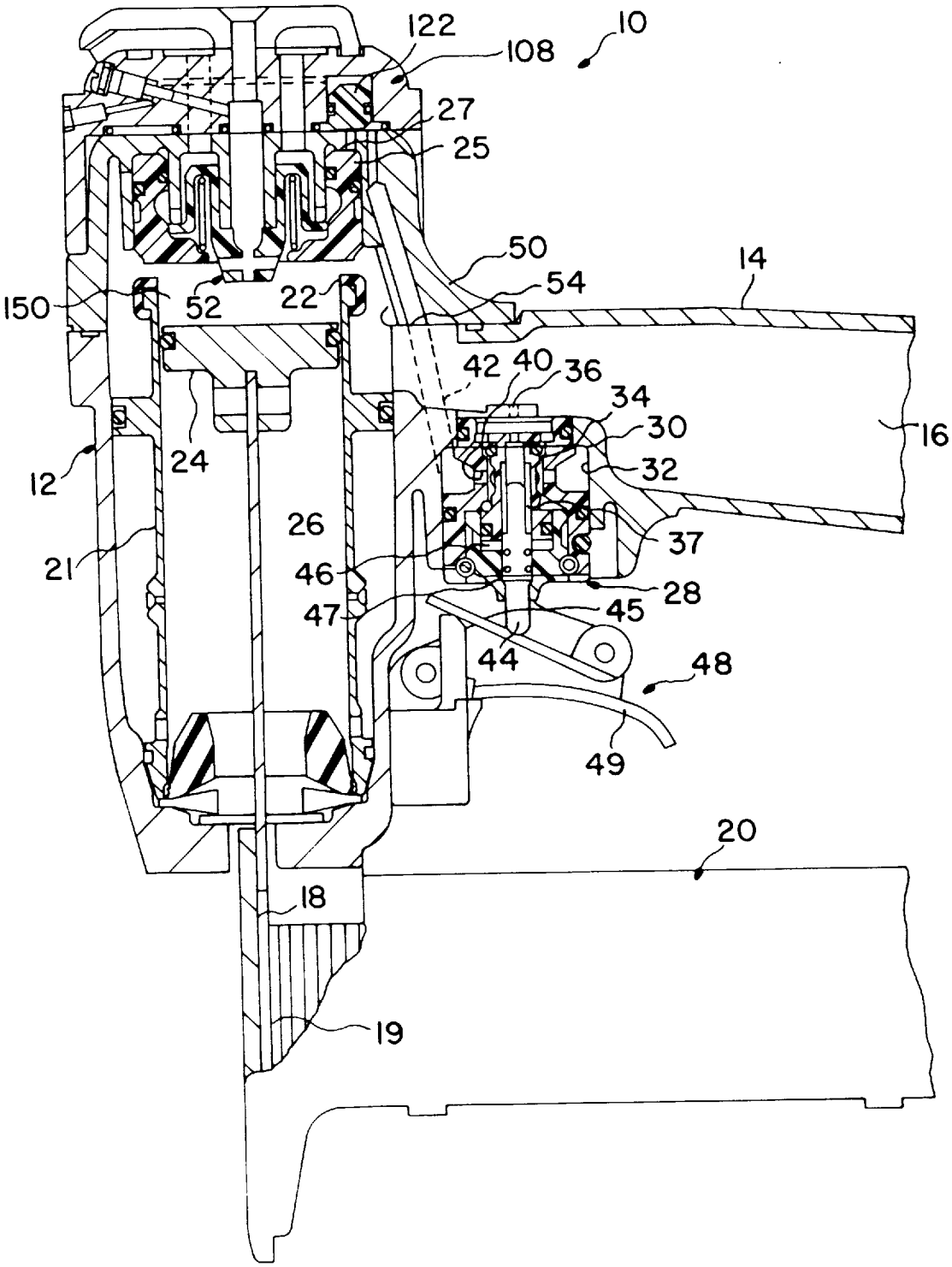
FIG. 1 is a partial sectional view of a fastener driving device including a main valve and secondary valve member.

Referring now more particularly to the drawings, a pneumatically operated fastener driving device, generally indicated at 10, is shown in FIG. 1, which embodies the principles of the present invention. The device 10 includes the usual housing assembly, generally indicated at 12, which includes a hand grip portion 14 of hollow configuration which constitutes a reservoir chamber 16 for supply air under pressure coming from a source which is communicated therewith. The housing assembly 12 further includes the usual nose piece defining a fastener drive track 18 which is adapted to receive laterally therein the leading fastener 19 from a package of fasteners mounted within a fastener magazine, generally indicated at 20. The magazine is of conventional construction and operation.

The housing assembly 12 includes a main body portion including a cylinder 21 therein which has its upper end 22 disposed in communicating relation with the reservoir chamber 16. A piston 24 is slidably sealingly mounted in the cylinder for movement through repetitive cycles each of which includes a drive stroke and a return stroke. A fastener driving element 26 is operatively connected to the piston 24 and is slidably mounted within the drive track 18 and movable by the piston 24 through a drive stroke in response to the drive stroke of the piston, during which the fastener driving element 26 engages a fastener within the drive track 18 and moves the same longitudinally outwardly into a workpiece, and a return stroke in response to the return stroke of the piston.

A main valve, generally indicated at 25, is provided for controlling communication of the supply air to the upper end 22 of the cylinder 21 to effect the driving movement of the piston 24 and the fastener driving element 26. The main valve 25 is pilot pressure operated and the pilot pressure chamber 27 thereof is under the control of an actuating valve mechanism, generally indicated at 28. Means is provided within the housing assembly 12 to effect the return stroke of the piston 24. For example, such means may be in the form of a conventional plenum chamber return system such as disclosed in U.S. Pat. No. 3,708,096, the disclosure of which is hereby incorporated by reference into the present specification.

The valve mechanism 28 is conventional and of the type disclosed in U.S. Pat. No. 5,083,694, the disclosure of which is hereby incorporated by reference into the present specification. The valve mechanism 28 includes a valve housing 30 sealingly engaged within a recess 32 formed in the handle portion 14 of the housing assembly 12. Mounted within the valve housing 30 is a tubular valve member 34. The valve member 34 is resiliently biased by a spring 37 into a normally inoperative position as shown in FIG. 1, wherein a supply of air under pressure within the hollow handle portion 14 of the housing assembly 12 is enabled to pass through an inlet opening 36 in the valve housing 30 in and around the tubular valve member 34 through the central openings 40 in the valve housing 30 and into a passage 42, which communicates with the pilot pressure chamber 27 for the main valve 25. When the pilot pressure chamber 27 is exposed to high pressure, the main valve 25 is in a closed position. The main valve 25 is pressure biased to move into an opened position when the pressure in the pilot pressure chamber 27 is relieved. The pilot pressure is relieved when the tubular valve member 34 moves from the inoperative position into an operative position discontinuing the communication of pressure in the reservoir chamber 16 with the pilot pressure chamber 27 and exhausting pressure in the pilot pressure chamber 27 to atmosphere. This movement is under the control of an actuator 44 which is mounted for rectilinear movement in a direction toward and away from a trigger assembly, generally indicated at 48.

As shown in FIG. 1, the valve mechanism 28 includes a lower portion defining a control chamber 46 which serves to trap air under pressure therein entering through the inlet 36 through the hollow interior of the valve mechanism 28. Pressure from the supply within the reservoir chamber 16 thus works with the bias of the spring 37 to maintain the valve member 34 in the inoperative position. In this position, pressure within passage 42 is prevented from escaping to atmosphere. When the actuator 44 is moved into its operative position by movement of a trigger member 49 of the trigger assembly 48, the supply of pressure within the control chamber 46 is dumped to atmosphere through exhaust port 45 and the tubular valve member 34 moves downwardly under the supply air. Thus, the supply pressure within the reservoir chamber 16 is sealed from passage 42 and passage 42 is communicated to atmosphere. As pilot pressure from passage 42 is allowed to dump to atmosphere, the pressure acting on the main valve 25 moves the same into its opened position which communicates the air pressure supply with the piston 24 to drive the same through its drive stroke together with the fastening driving element 26. The fastener driving element 26 moves a fastener which has been moved into the drive track 18 from the magazine assembly 20 outwardly through the drive track 18 and into the workpiece. O-rings 47 seal the exhaust port 45 when the actuator 44 is in its inoperative position.

Figure 2:
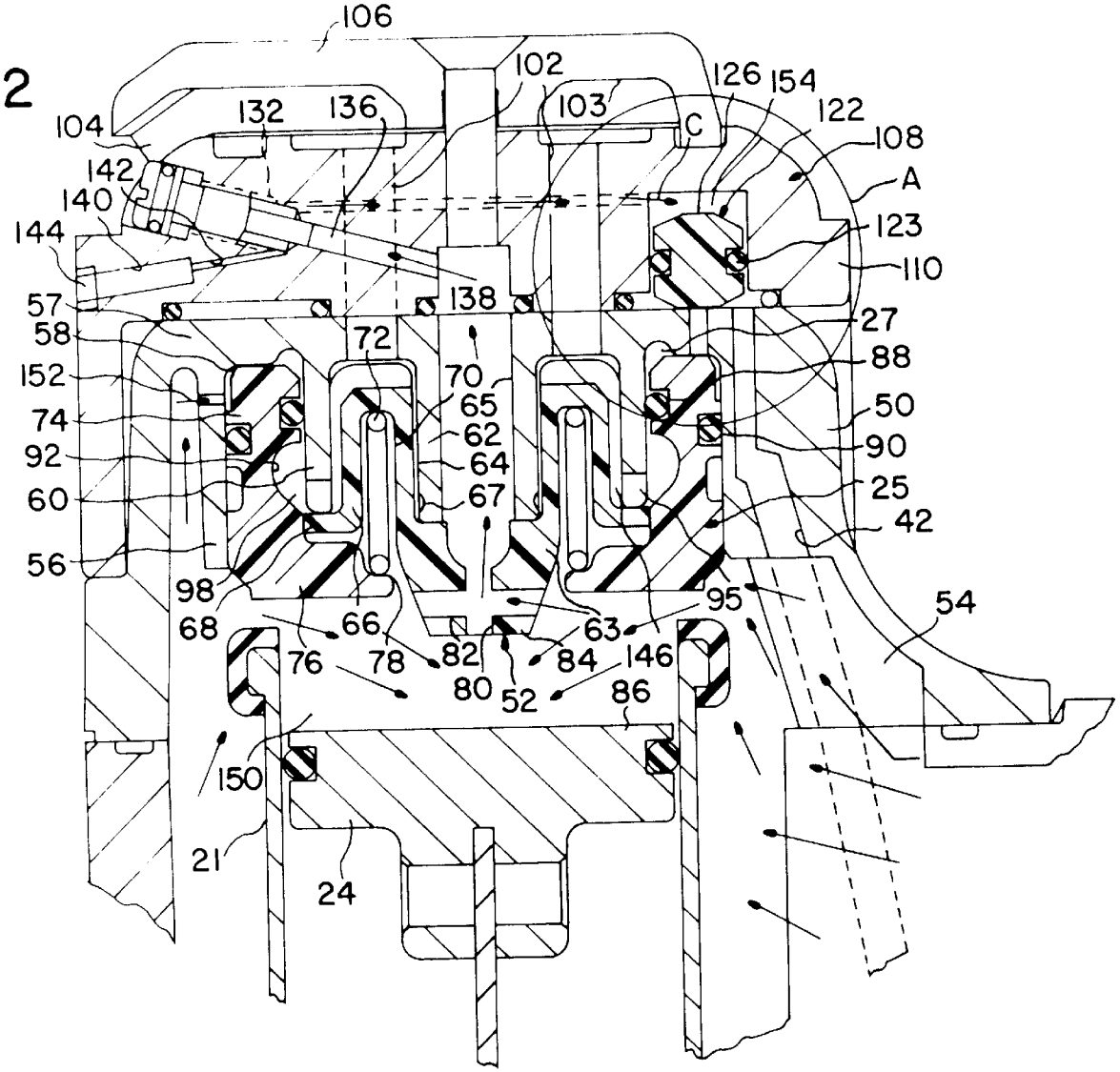
FIG. 2 is an enlarged, sectional view of the device of FIG. 1, shown in a position during a drive stroke of the piston of the device.
Figure 3:
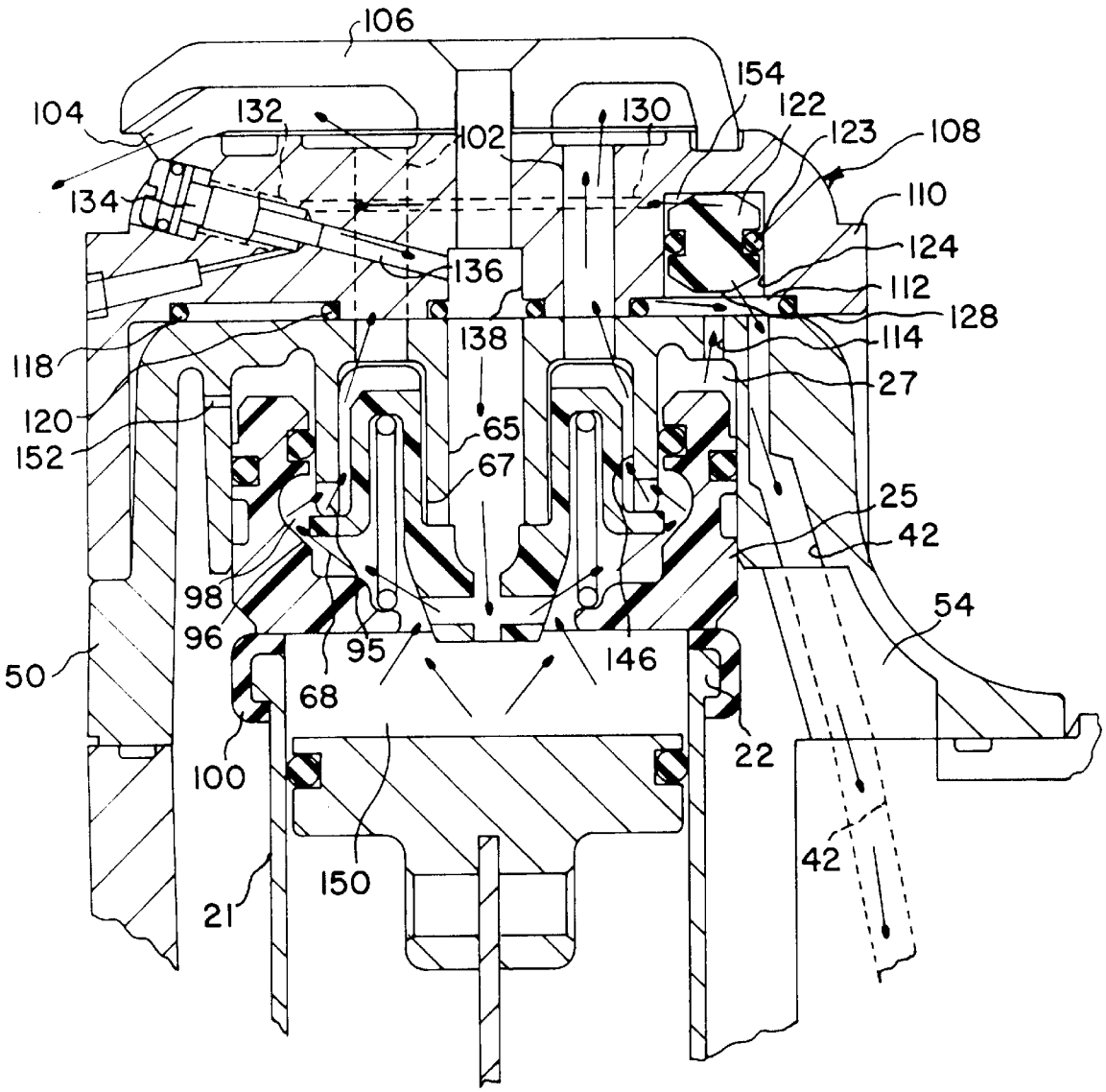
FIG. 3 is an enlarged, sectional view of the device of FIG. 1, shown in a position during a return stroke of the piston.

Referring now more particularly to FIGS. 2 and 3, the main valve 25 and a piston stop, generally indicated at 52, are mounted in a cap member 50, above the cylinder 21. The cap member 50 is removable from the housing assembly 12, but the cap member 50 is considered to be part of the housing assembly 12. Fasteners (not shown) secure the cap member 50 to the housing assembly 12. The piston stop 52 is fixed within the cap member 50. A lower end of the cap member 50 includes an opening 54 communicating with the reservoir chamber 16. The pilot pressure chamber 27 is annular in configuration and is defined along its outer periphery by an outer cylindrical portion 56 of the cap member 50. The outer cylindrical portion 56 extends downwardly from an inner periphery of the annular wall 57 of the cap member 50. The lower surface 58 of the cap member 50 defines an upper end of the annular pilot pressure chamber 27. The inner periphery of the pilot pressure chamber 27 is defined by the exterior of an inner cylindrical portion 60 which also extends downwardly from the inner periphery of the annular wall 57 of the cap member 50. The cap member 50 further includes a central hollow cylindrical portion 62, defining a central passage 65 therethrough, extending downwardly from the annular wall portion 57.

A central portion 63 of the piston stop 52 includes an annular recess 64 which is frictionally engaged with the outer periphery of the central cylindrical portion 62. A seal 67 is disposed between the cylindrical portion 62 and the central portion 63. As shown in FIG. 2, the piston stop 52 includes a outer annular member 66 terminating in an outwardly extending seating surface 68. An annular recess 70 is defined between the annular member 66 and the central portion 63 of the piston stop 52. A spring 72 is disposed in the recess 70, about the central portion 63 of the piston stop 52.

The main valve 25 is generally cylindrical and includes a cylindrical portion 74 and an annular portion 76 extending therefrom. The annular portion 76 includes an annular spring seating surface 78 adjacent an inner peripheral portion of the main valve 25 and engaged with the spring 72 such that the spring 72 biases the main valve 25 downwardly, towards its closed position.

The central portion 63 of the piston stop 52 includes a bore 80 through the center thereof and a cross-bore 82 communicating with the bore 80. Bores 80 and 82 communicate with the passage 65 of the cap member 50, the function of which will become apparent below. The piston stop 52 further includes a stop surface 84 extending downwardly so as to engage surface 86 of the piston 24 during the return stroke thereof. The piston stop 52 and main valve 25 are preferably composed of plastic so as to reduce the overall weight of the device 10.

An inner O-ring seal 88 is mounted in an interior annular groove and an outer O-ring seal 90 is mounted in an exterior annular groove in the cylindrical portion 74 of the main valve 25. The seals 88 and 90 and the upper surface of the main valve 25, extending therebetween, define the lower end of the pilot pressure chamber 27.

An inner annular groove 92 is defined in the main valve 25 in a position so as to be generally adjacent passageways 95 defined in the inner cylindrical portion 60 when the main valve 25 is disposed in its closed position, as shown in FIG. 3. An inner peripheral surface 96 of the main valve is constructed and arranged to engage the seating surface 68 of the piston stop 52 which closes an exhaust passageway 98, when the main valve 25 is in its opened position.

The closed position of the main valve 25 is shown in FIG. 3. It will be noted that a resilient annular pad-like element 100 is mounted on the end 22 of the cylindrical member 21 and defines a seating surface which is engaged by the main valve 25, thereby preventing supply pressure in reservoir chamber 16 from entering the end 22 of the cylinder 21. When the main valve 25 is in its closed position, passageway 98 is open to the piston chamber 150 so that pressure may exhaust through the passageways 95 and through the exhaust paths 102 and through port 104 in cap 106. As shown in FIG. 3, the exhaust paths 102 extend through the housing 110 and through the cap member 50 so as to communicate with annular chamber 146 between the piston stop 52 and cover member 50. Chamber 146 communicates with passage 95. The exhaust paths 102 communicate with the annular passage 103 defined in a cap 106.

An automatic valve module, generally indicated at 108, is mounted above the cap member 50, as shown in FIGS. 1–3, and secured to the housing assembly by the fasteners (not shown) which secure the cap member 50 to the housing assembly 12. The valve module 108 may be considered part of the housing assembly 12. The automatic valve module 108 includes a housing 110, preferably of aluminum or other light-weight material. The housing 110 includes an annular recess 112 which communicates with a vertical passage 114, defined in the cap member 50. The vertical passage 114 is in communication with the pilot pressure chamber 27. Vertical passage 114, recess 112 and passage 42 define first passage structure communicating the supply pressure with the pilot pressure chamber 27, as pilot pressure therein. O-rings 118 and 120 are provided to seal the connection between the housing 110 and the cap member 50.

A secondary valve member in the form of a shuttle valve 122, preferably of plastic material, is mounted within bore 124 of the housing 110 so as to communicate with the vertical passage 114. The shuttle valve 122 is generally cylindrical and has a first pressure responsive surface 126 and a second pressure responsive surface 128 disposed opposite the first pressure responsive surface 126. Surfaces 126 and 128 have equal surface areas. An O-ring seal 123 is provided in the periphery of the shuttle valve 122 which isolates the first and second pressure responsive surfaces, 126 and 128, respectively. In the illustrated embodiment, each of the pressure responsive surfaces 126 and 128, tapers from a generally planar central portion. As shown in FIG. 2, when the shuttle valve 122 is in its closed position, it closes the vertical passage 114 preventing the pilot pressure chamber from communicating with the passage 42 and thus the exhaust port 45. A passage 130 communicates with an upper end of a shuttle cavity 154 and extends to a needle valve cavity 132. A conventional needle valve, generally indicated at 134, is disposed within the needle valve cavity 132 for adjustably controlling piston dwell at the top of the piston stroke. The needle valve cavity 132 is also in communication with a passage 136 which is in communication with recess 138 and with central passage 65. These passages 130, 132, 136, 136, 65 and 80 cooperate to define second passage structure directly communicating the shuttle cavity 154 with the piston chamber 150.

In the illustrated embodiment, a shuttle chamber 140 is provided within the housing 110 and communicates with the needle valve cavity 132 via passageway 142. The shuttle chamber 140 is sealed by a set screw 144. The shuttle chamber 140 provides a volume which aids in reducing the needle valve adjustment sensitivity during operation of the device 10.

The movement of the shuttle valve 122 to produce repeated operation of the device 10 will be appreciated with respect to FIGS. 4–9. Initially, with reference to FIG. 4, when the device 10 is at rest, passage 42 is in communication with supply pressure since the actuator 44 is in its inoperative, sealed position sealing exhaust port 45. The second pressure responsive surface 128 of the shuttle valve 122 is exposed to supply pressure, biasing the shuttle valve 122 to its opened position. When the shuttle valve 122 is disposed in its opened position, passage 42 communicates with the pilot pressure chamber 27 via the vertical passage 114. In addition, supply pressure enters the pilot pressure chamber via feed orifice 152. Feed orifice 152 is constructed and arranged to control the piston dwell at the bottom of its stroke. Thus, the main valve 25 is biased to its closed position via spring 72 and by supply pressure in pilot pressure chamber 27. The first effective pressure surface 126 of the shuttle valve 122 is exposed to atmospheric pressure via passage 130, since passage 130 is ultimately in communication with the exhaust port 104.

To initiate actuation of the device 10, the trigger 49 is digitally pressed, moving the actuator 44 to its operative, unsealed position. As a result, the supply pressure within the reservoir chamber 16 is sealed from passage 42 and passage 42 is communicated to atmosphere via exhaust port 45. Thus, the pressure within the pilot pressure chamber 27 is dumped to atmosphere through passage 114, recess 112, passage 42 and port 45, permitting the supply pressure acting on a lower surface of the main valve 25 to move the same into its opened position (FIG. 5). When the main valve 25 is open, the air pressure supply communicates with the piston 24 to drive the piston 24 through its drive stroke together with the fastener driving element 26. When the main valve 25 is in its opened position, the exhaust passageway 98 is sealed due to the engagement of the inner peripheral portion 96 of the main valve 25 with the seating surface 68 of the piston stop 52, as shown in FIG. 2. At the end of the drive stroke of the piston 24, the over-the-piston pressure, in piston chamber 150, is supply air or high pressure air and this high pressure air begins to enter passage 130 (see arrows C in FIG. 5), via passages 80, 65, 138 and 136, as shown in FIGS. 2 and 5. The term "over-the-piston pressure" used herein is the pressure in the piston chamber 150, above the piston 24. The over-the-piston pressure goes from high to low pressure during cycling of the device 10.

With reference to FIGS. 2 and 6, during a portion of the return stroke of the piston 24, the over-the-piston pressure in piston chamber 150, which is high pressure, communicates, via the secondary passage structure including passage 130, with the first effective pressure responsive surface 126 of the shuttle valve 122. This pressure communication causes the shuttle valve 122 to move to its closed position, preventing the passage 42 from communicating with the pilot pressure chamber 27. At this time, the pilot pressure chamber 27 is filled with supply pressure via an automatic feed orifice 152, as shown in FIG. 2, (which controls the piston dwell at the bottom of the piston stroke) so as to bias the main valve 25 to its closed position and thus open the exhaust passageway 98, permitting the device 10 to exhaust via passages 95 and 102. Over-the-piston pressure, shown by arrows D in FIG. 7, communicates with passage 130 and shuttle cavity 154. At this stage of the return stroke of the piston 24, the shuttle valve 122 beings to open when the force created by the over-the-piston pressure acting on surface area A (FIG. 7) of the shuttle valve 122 is equal to the force created by supply pressure acting on surface area B. When the shuttle valve 122 is in its opened position, the device 10 exhausts fully, as shown by the arrows in FIG. 3, completing the return stoke of the piston 24. The passage 42 remains unsealed and opened to the atmosphere since the trigger 49 is still actuated.

With reference to FIG. 8, upon completion of the return stroke of the piston 24 and with the shuttle valve 122 in its opened position due to low pressure in shuttle cavity 154, another piston drive stoke is initiated. Thus, the supply air in the pilot pressure chamber 27 is dumped to atmosphere via passage 114, recess 112, passage 42 and exhaust port 45, in the manner discussed above, causing the main valve 25 to move to its opened position. This action initiates another piston and fastener driving element drive stroke. Thereafter, the over-the-piston pressure in passage 130 and shuttle cavity 154 begins to go to high pressure, as shown by arrows C in FIG. 9, which will cause the shuttle valve 122 to move to its closed position, as discussed above.

It can thus be seen that the main valve 25 and shuttle valve 122 arrangement ensures automatic, repeated movement of the piston and fastener drive element so long as the trigger 49 remains actuated. The device 10 does not have a single actuation setting. However, for high speed settings, the cavity 140 (FIG. 2) may be constructed and arranged so as to create a pneumatic delay between the first and second tool actuations to provide adequate time to release the trigger 49 for single actuation.

Figure 10:
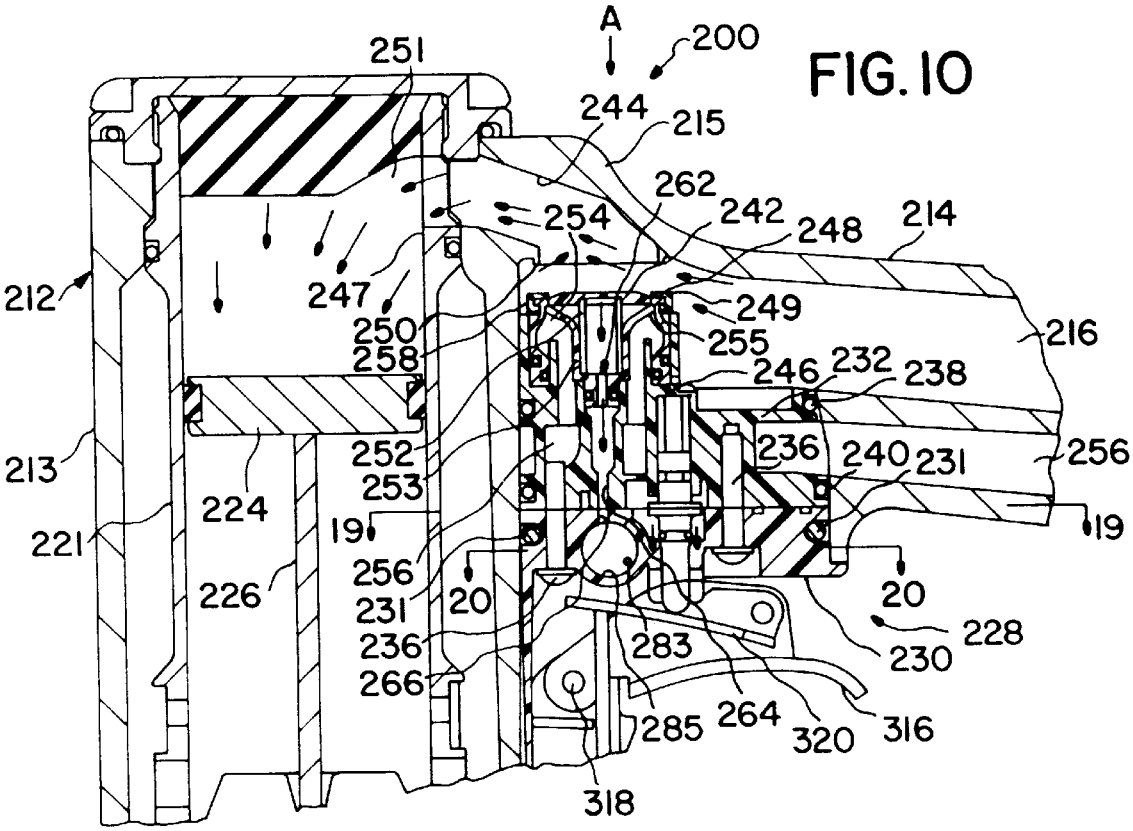
FIG. 10 is a sectional view of a fastener driving device including a control valve module provided in accordance with a second embodiment of the invention.

A second embodiment of the invention is shown in FIGS. 10–20. A pneumatically operated fastener driving device, generally indicated at 200, is shown in FIG. 10. The device 200 includes a housing, generally indicated at 212, having a cylindrical housing portion 213 and a frame housing portion 215, extending laterally from the cylindrical housing portion 213. A hand grip portion 214 of hollow configuration is defined in the frame housing portion 215, which constitutes a reservoir chamber 216 for air under pressure coming from a source which is communicated therewith. The housing 212 further includes the usual nose piece defining a fastener drive track (not shown) which is adapted to receive laterally therein the leading fastener from a package of fasteners mounted within a magazine assembly (not shown) of conventional construction and operation. Mounted within the cylindrical housing portion 213 is a cylinder 221 which has its upper end disposed in communicating relation with the reservoir chamber 216 via passage. Mounted within the cylinder 221 is a piston 224. Carried by the piston 224 is a fastener driving element 226 which is slidably mounted within the drive track and movable by the piston and cylinder unit through a cycle of operation which includes a drive stroke during which the fastener driving element 226 engages a fastener within the drive track and moves the same longitudinally outwardly into a workpiece, and a return stroke.

In order to effect the aforesaid cycle of operation, there is provided a control valve assembly, generally indicated at 228, constructed in accordance with the present invention. The control valve assembly 228 includes a housing unit, which, in the illustrated embodiment includes a trigger housing 230 removably coupled to the frame portion 215 by pin connections at 231, and a valve housing 232 secured to the trigger housing 230 by fasteners, preferably in the form of screws 236. Housings 230 and 232 are preferably molded from plastic material. O-rings 238 and 240 seal the valve housing 232 within the frame portion of the housing 212.

Referring now more particularly to FIG. 10, the control valve assembly 228 includes a main valve 242 mounted with respect to the valve housing 232 and associated with the passageway 244 between one end 247 of the cylinder 221, defining piston chamber 251, and the reservoir chamber 216. The main valve 242 is moveable between opened and closed positions to open and close the passageway 244 and has a first annular pressure responsive surface 246 and a second, opposing annular pressure responsive surface 248. When the main valve is closed, a portion 249 of surface 248 extends beyond annular housing seat 250 and is exposed to reservoir pressure in the reservoir 216. Spring structure, in the form of a coil spring 252 biases the main valve 242 to its closed position, together with reservoir pressure acting on surface 246. Thus, the force of the spring 252 plus the force acting on surface 246 is greater than the force due to pressure acting on the portion 249 of the opposing surface 248, which results in the keeping the main valve 242 in its closed position. The spring 252 is disposed between a surface of an exhaust seal 253 and a surface of the main valve 34. The exhaust seal 253 is fixed to the valve housing 232 and an upper annular surface 255 thereof contacts an inner surface of the main valve 242 when the main valve is in its fully opened position thereby closing an exhaust path 254. Exhaust path 254 communicates with the atmosphere via exhaust 256.

A urethane seal member 258 is attached to the main valve 242 at surface 248 and ensures sealing when the main valve is closed. When the main valve 242 is in its closed position, surface 248 of the main valve is in sealing engagement with seat 250 of the housing 212. O-ring seals 260 are provided for sealing the main valve 242 within the valve housing 232.

An axial passage structure, generally indicated at 262, is defined through the main valve 242 and exhaust seal 253. The passage structure 262 includes passage 264 of the valve housing 232 and passage 266 of the trigger housing 230. The passage structure 262 provides a pressure signal to secondary valve structure, as will become apparent below.

A pilot pressure chamber 268 (FIG. 11) is defined between the first pressure responsive surface 246 of the main valve 242, and a portion of the valve housing 232. The pressure chamber 268 is in communication with the reservoir or high pressure in chamber 216 via a feed orifice 270. This high pressure in chamber 268 is dumped to atmosphere to open the main valve 242, as will be explained below.

Figure 11:
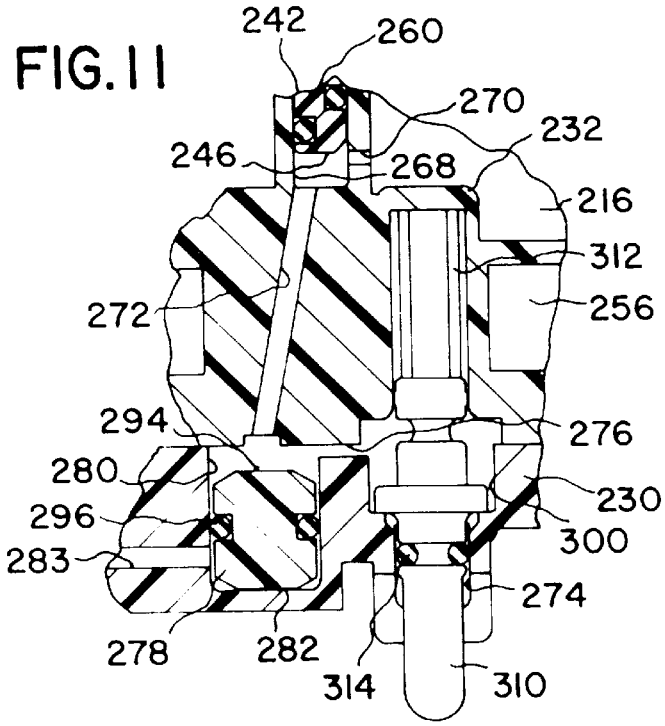
FIG. 11 is a partial sectional view of the valve module of FIG. 10 showing the relative positions of the main valve and secondary valve member when the device is at rest.

With reference to FIG. 11, a passage 272 connects the pressure chamber 268 and an exhaust port 274 via a restrictive bleed path 276. Passage 272, bore 280, bleed path 276 define first passage structure between the pressure chamber 268 and the exhaust port 274, the function of which will be apparent below.

The control valve assembly 228 includes a secondary valve member in the form of a shuttle valve 278 mounted in bore 280 of trigger housing 230 (FIG. 11). The shuttle valve 278 is generally cylindrical and has a first effective pressure surface 282 which is in pressure communication with over-the-piston pressure which is the pressure communicating with the piston chamber 251. This pressure may be low or high pressure, depending on what part of the cycle the device is operating. Such communication is achieved since surface 282 communicates with port 283, which in turn communicates with needle valve bore 285, which is in communication with the axial passage structure 262, via passage 264 of valve housing 232 and passage 266 of trigger housing 230. The axial passage structure 262 is opened to passage 244 and thus open to the piston chamber 251. These passages define second passage structure providing direct communication between the shuttle valve and the piston chamber 251.

A needle valve assembly, generally indicated at 284 (FIG. 20) is housed in bore 285. The needle valve assembly 284 includes a manually adjustable needle valve 286. A pressure path 288 communicates with the needle valve 286, the port 283 and passage 266. When the valve housing 232 is coupled to the trigger housing 230, a pressure cavity 292 is defined and port 290 communicates the pressure cavity 292 (FIG. 19) with the port 283. The restriction defined by the needle valve 286 selectively controls the piston dwell at the top of its stroke. Further, pressure cavity 292 reduces the sensitivity of the needle valve 286. An O-ring seal member 300 provides a seal between the trigger housing 230 and the valve housing 232.

The shuttle valve 278 has a second pressure surface 294 opposing the first pressure surface 282 and in communication with the reservoir chamber 268 via port 272. Surfaces 294 and 282 have equal areas. As shown in FIG. 11, when the shuttle valve 278 is in its opened position normally biased by reservoir pressure at surface 278, communicated from port 272 and bore 280 via feed orifice 270, passage 272 communicates with the restrictive bleed path 276. O-ring 296 prevents the reservoir or high pressure air from passing the shuttle valve 278. Surface 282 is exposed to atmospheric pressure since over-the-piston pressure in port 283 is atmospheric pressure at exhaust 256.

Figure 12:
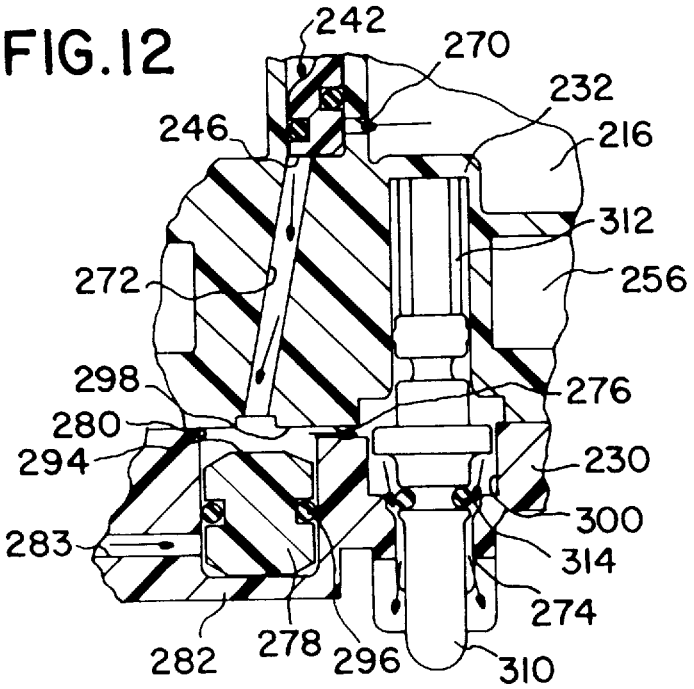
FIG. 12 is a sectional view similar to FIG. 11, showing an actuating member actuated moving the main valve to an opened position.

With reference to FIG. 12, when over-the-piston pressure or high pressure acts on surface 283 imposing a greater force than a force acting on surface 294 due to reservoir pressure communicating therewith, the shuttle valve 278 is moved towards its closed position wherein surface 294 of the valve 278 engages surface 298 of the valve housing 232 so as to prevent communication between port 272 and the exhaust port 274. O-ring 296 prevents pressure in port 283 from communicating with passage 272 and path 276.

As shown in FIG. 11, the restrictive bleed path 276 connects the passage 272 and bore 280 with a trigger stem bore 300. The trigger stem bore 300 communicates with the exhaust port 274. A trigger stem 310, defining an actuator, is carried by the trigger housing 230 for movement from a normal, sealed position into an operative, unsealed position for initiating movement of the main valve 242 to its opened position, thereby initiating movement of the fastener driving element 226 through a fastener drive stroke. The actuator 310 is normally biased to its normal, sealed position by a coil spring 312. As shown in FIG. 11, in the sealed position, the actuator 310 engages a surface of the trigger housing 230 with an O-ring 314 compressed therebetween, sealing the exhaust port 274.

With reference to FIG. 10, the control valve assembly 228 includes a trigger assembly including a trigger member 316 pivoted to the trigger housing 230 at pin 318 for manual movement from a normal, inoperative position into an operative position. The trigger assembly also includes a rocker arm 320 which is pivoted to the trigger member 316 via a pin. Upward movement of the trigger member 316 causes the rocker arm 320 to engage and move the actuator 310 from its sealed position to its operative, unsealed position.

The operation of the control valve assembly 228 will be appreciated with reference to FIGS. 10–20. As shown in FIG. 11, when the device 200 is at rest, reservoir pressure from feed orifice 270 acting on surface 246 biases the main valve 242 against seat 250 of the housing preventing reservoir pressure to enter the open end 246 of the cylinder 221. The main valve 242 is biased upwardly since surface area 246 is greater than the surface area of portion 249 extending beyond seat 250. Reservoir pressure enters the passage 272 and bore 280 and biases the shuttle valve 278 to its opened position due to pressure being exerted on surface 294 of the shuttle valve. Over-the-piston pressure in port 283 is low pressure since the upper end 246 of the cylinder 221 is exposed to atmospheric pressure via the axial passage 262 and exhaust 256. The actuating member 310 is in its normal, sealed position with exhaust port 274 enclosed.

Figure 13:
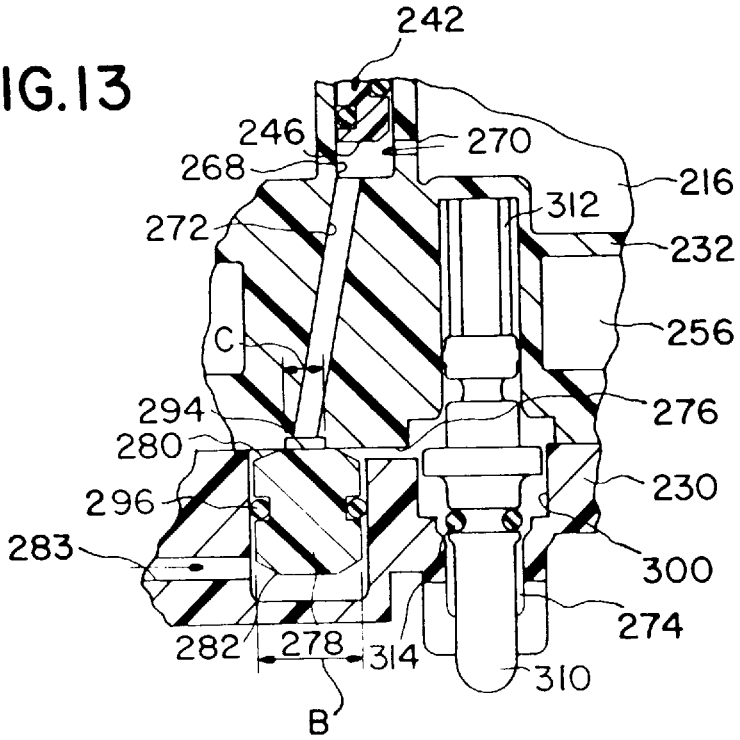
FIG. 13 is a view similar to FIG. 12, showing the main valve and secondary valve member in closed positions during a return stroke of the piston.

As shown in FIG. 12, when the actuator 310 is moved upwardly by manual movement of the trigger 316, exhaust port 274 is opened which dumps the pressure in the pilot pressure chamber 268 to atmosphere via the passage 272, bore 280 and bleed path 276. This causes the main valve to shift to its opened position as shown in FIG. 10, permitting reservoir pressure to pass through passageway 244 and into the piston chamber 251 to cause the fastener driving element to move through a drive stroke. At this time, over-the-piston pressure begins to go to high pressure since reservoir pressure passes through the axial passageway 262 into port 285 and into port 283. As shown in FIG. 13, with the actuator 310 still actuated, during the return stroke of the fastener driving element, the over-the-piston pressure or high pressure in passage 283 shifts the shuttle valve 278 to its closed position preventing communication between passage 272 and the exhaust port 274.

As shown in FIG. 12, when the main valve 242 is opened fully, the force created by reservoir pressure acting on pressure surface 248 is greater than the force of the spring 252 at its compressed height plus the force created by the atmospheric pressure acting on pressure surface 246. In this position, the main valve 242 engages valve element 255 which closes passageway 254 preventing reservoir pressure at the upper end 246 of the cylinder from exiting the device 200 through the exhaust 256.

Over-the-piston pressure air or high pressure air bleeds through the axial passage 262 through pressure path 288 and needle valve bore 285 under the shuttle valve 278 and into port 290 and thus into cavity 292. Cavity 292 is similar to cavity 140, discussed above, and provides a volume which aids in reducing the needle valve adjustment sensitivity. Over-the-piston pressure air builds in cavity 292 communicating with surface 282 of the shuttle valve 278, thus, shifting the shuttle valve 278 to its closed position, as shown in FIG. 13. This occurs since force created by over-the-piston pressure acting in surface area B is greater than reservoir pressure acting in surface area C. The shuttle valve 278 prevents passage 272 from communication with exhaust port 274. Thus, chamber 268 is filled with reservoir pressure via feed orifice 270. The feed orifice controls the piston dwell at the bottom of its stroke. High pressure air then shifts the main valve 242 to its closed position such that seal 258 is engaged with seat 250 of the housing. Over-the-piston pressure exhausts through the axial passage structure 262 and through the exhaust 256. Over-the-piston pressure in cavity 292 bleeds through port 290 (FIG. 19) past the needle valve 286, and then bleeds through the pressure path 288, through passage 266 and housing passage 264 of the axial passage structure 262 and finally out through the exhaust 256. High pressure under the shuttle valve 278 acting on surface 282 bleeds to atmosphere, thus reservoir pressure on surface 294 shifts the shuttle valve 278 to its opened position. The reservoir pressure under the main valve 242 in chamber 268 is then released through passage 272, through bore 280 and the restrictive path 276 and through the exhaust port 274 to atmosphere. High pressure in reservoir 216 forces the main valve 242 to its opened position in the manner discussed above, thus, driving the piston downwardly. The working cycle of the piston is repeated as long as the actuator 310 is held in its unsealed, actuated position. Release of the trigger member 316 returns the device to its rest position. The shuttle valve 278 begins to open when a force created by over-the-piston pressure acting on surface area B equals a force created by reservoir pressure acting on surface area C. Surface area C is significantly less than surface area B. It has been determined that the greater the ratio between surface area B and surface area C, more bleed down occurs and thus, a better signal is produced. This makes the device more responsive.

Figure 14:
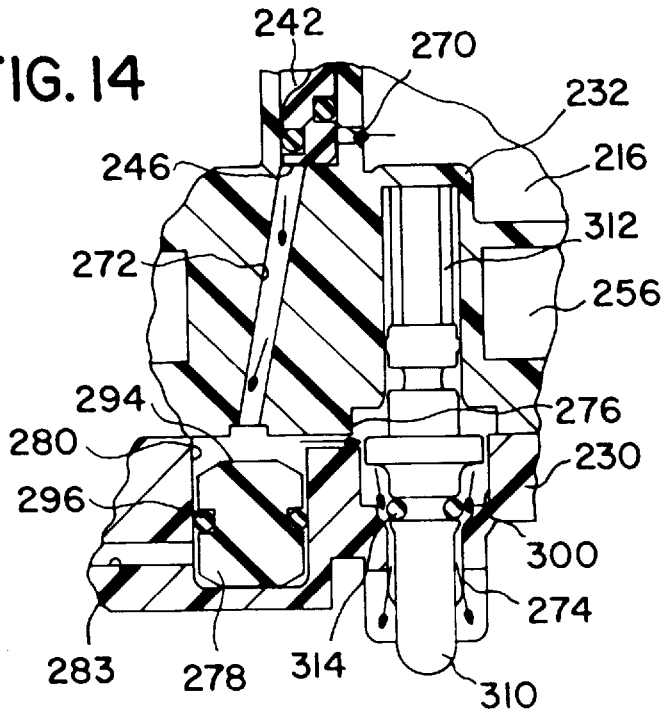
FIG. 14 is a view similar to FIG. 12, showing the main valve and the secondary valve member in opened positions during the drive stroke of the piston.

FIG. 14 shows the shuttle valve in its opened position biased by reservoir pressure acting on surface 294 with port 283 exposed to over-the-piston pressure which is atmospheric pressure.

Figure 15:
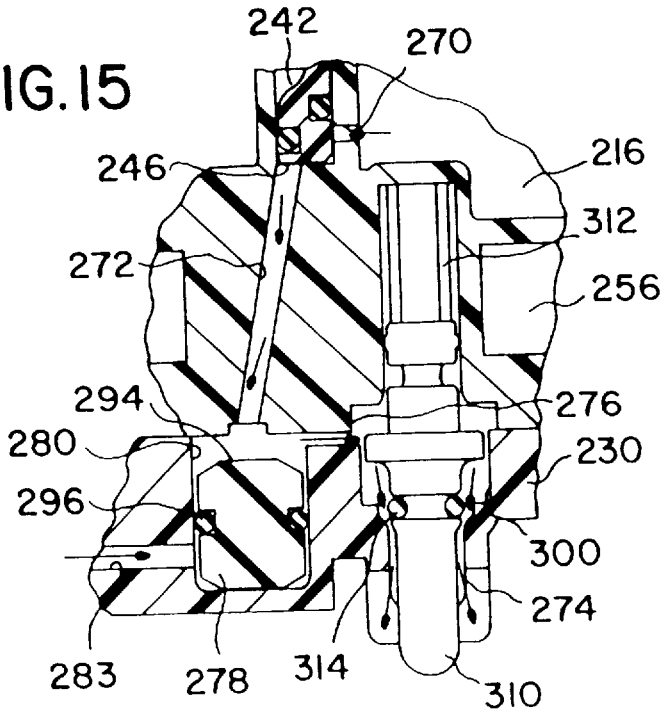
FIG. 15 is a view similar to FIG. 14, showing over-the-piston pressure acting on the secondary valve member going to high pressure.

FIG. 15 shows over-the-piston pressure in port 283 beginning to go to high pressure to repeat the working cycle of the device 200.

Figure 18:
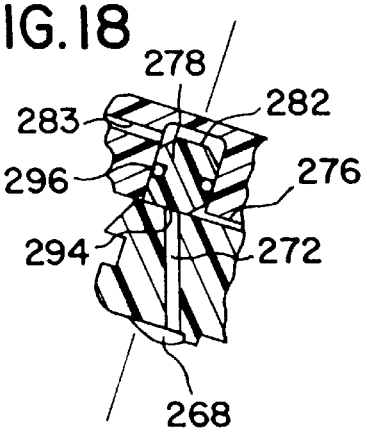
FIG. 18 is a partial sectional view taken along the line 17—17 in FIG. 16, showing the secondary valve member in a closed position.
Figure 17:
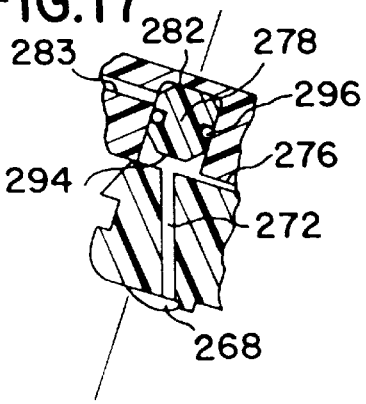
FIG. 17 is a partial sectional view taken along the line 17—17 of FIG. 16, showing the secondary valve member in an opened position.
Figure 19:
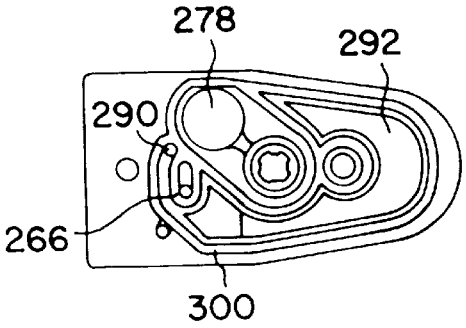
FIG. 19 is a view of the trigger housing of the control valve module taken along the line 19—19 of FIG. 10.
Figure 20:
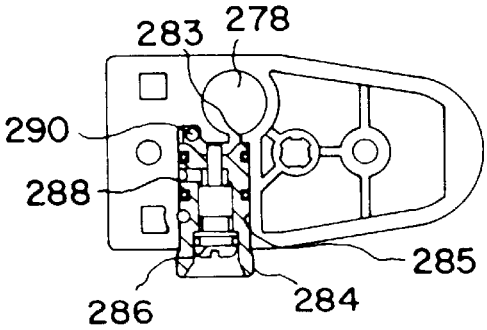
FIG. 20 is a view taken along the line 20—20 of FIG. 10.
Figure 16:
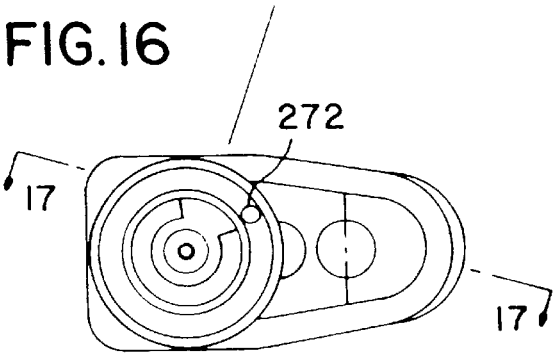
FIG. 16 is a view of a valve housing as seen in the direction of arrow A of FIG. 10, shown with the main valve removed for clarity of illustration.

With reference to FIGS. 17 and 18, the function of the restrictive path 276 will be appreciated. When passage 272 is open, restricted exhaust air in the restricted path 276 creates high pressure over the shuttle valve 278 on surface 294. The shuttle valve is thus shifted to its opened position by high pressure acting on surface 294. Path 276 creates pressure over the shuttle valve and a bleed down delay to ensure full shuttle valve stroke.

It can be appreciated that by positioning the main valve 242 in the frame of the device 200, the overall tool height is reduced. Further, since the control valve assembly 228 is in the form of a single unit, removable from the housing 212, the device is easy to assembly and service.

Figure 23:
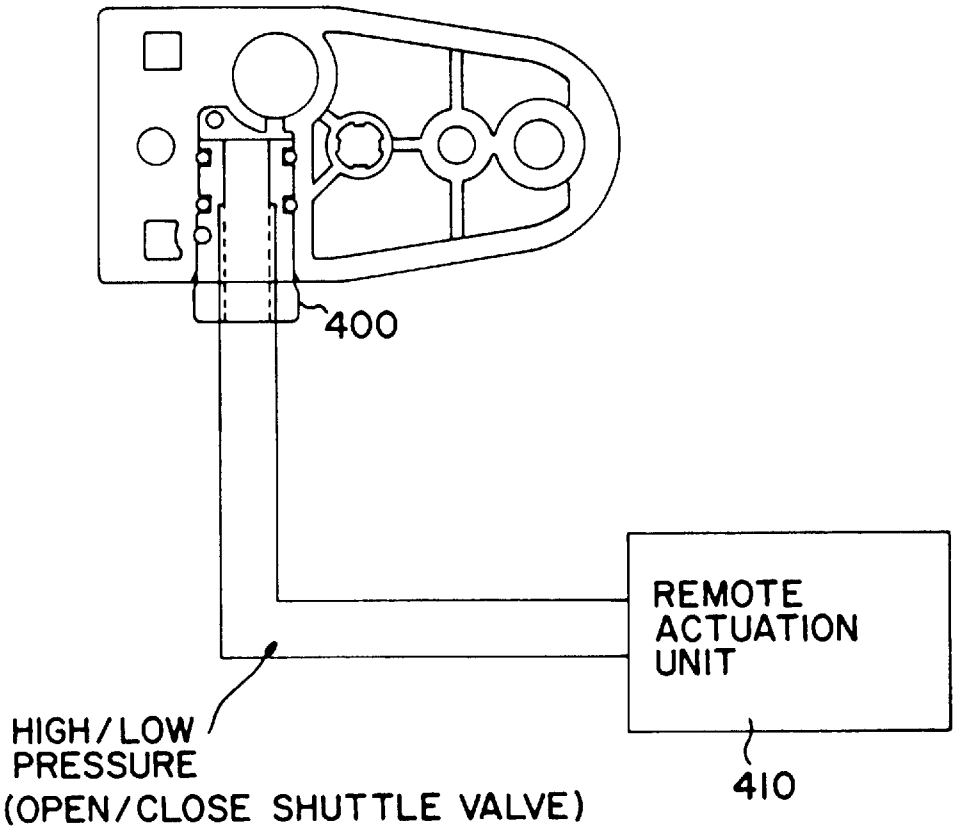
FIG. 23 is a schematic view showing a remote actuation unit operable to activate the shuttle valve by an auxiliary pressure source.

As shown in FIG. 23, the needle valve 286 can be replaced with a tapped housing 400, which is coupled to a remote actuating unit 410. With this arrangement, the shuttle valve 278 can be remotely actuated by an auxiliary pressure source.

Figure 21:
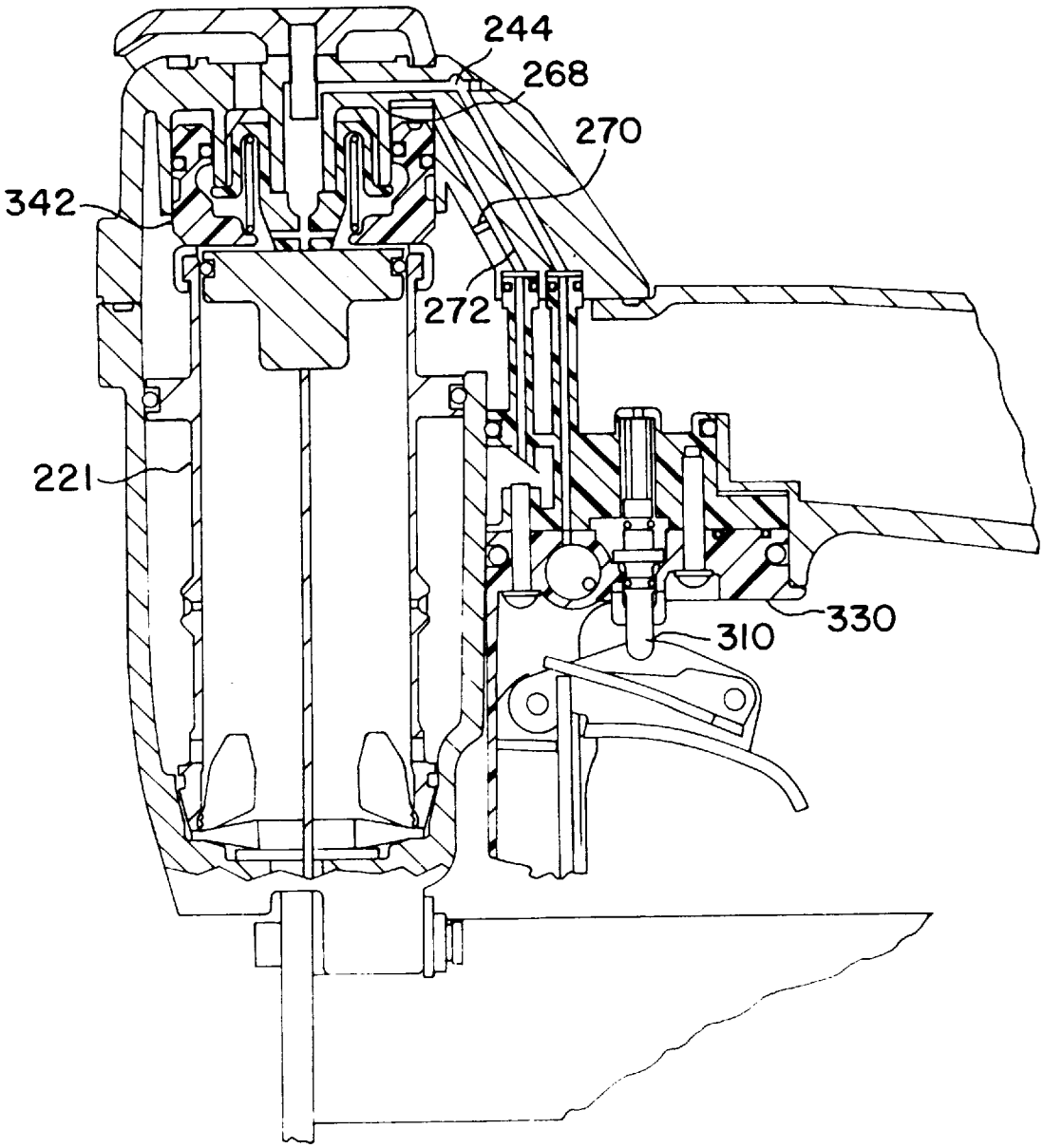
FIG. 21 is view of another embodiment of a fastener driving device including a secondary valve member and a remote main valve.

It can be appreciated that the main valve and shuttle valve may be arranged in various configurations to perform the same function as disclosed above. In particular, with reference to FIG. 21, it can be appreciated that an automatic valve may be provided with a remote main valve 342. With the arrangement shown in FIG. 21, the main valve 342 is disposed above the cylinder 221. The shuttle valve (not shown) is disposed in the trigger housing 230 as in the embodiment of FIG. 10. Feed orifice 270 supplies the pilot pressure chamber 268 with reservoir pressure via passage 272. An over-the-piston feed port 244 is provided which functions similarly as the axially passage of the previous embodiment. It can be appreciated that repeated cycling can occur once the actuator 310 is moved to its unsealed position.

Figure 22:
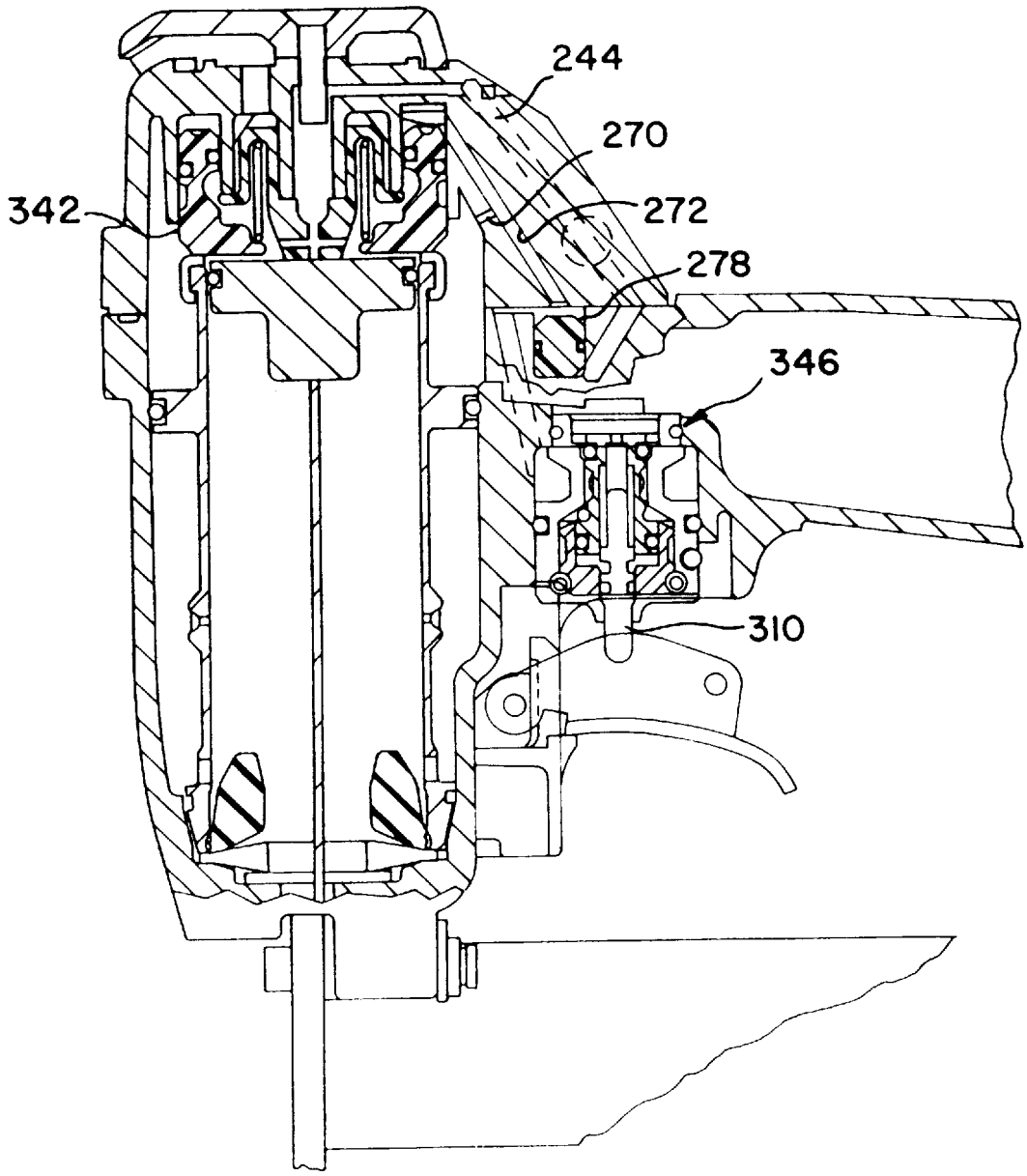
FIG. 22 is view of yet another embodiment of a fastener driving device including a secondary valve member and a remote main valve.

FIG. 22 shows yet another embodiment of the present invention. As shown, the shuttle valve 278 is disposed in the tool housing and a convention trigger assembly 346 is provided. It can be seen that in each embodiment, the shuttle valve operates in direct response to changes in over-the-piston pressure.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims. For example, although the shuttle valve 122 has been disclosed as being biased by pressure only, it can be appreciated that springs may be used together with pressure to bias the shuttle valve so as to enhance pneumatic delay.

What is claimed is:

1. A pneumatically operated fastener driving device comprising:

a housing assembly including a cylinder therein, said housing assembly defining a fastener drive track, a drive piston slidably sealingly mounted in said cylinder for movement through an operative cycle including a drive stroke and a return stroke, a fastener driving element operatively connected to said piston and mounted in said fastener drive track for movement therein through a drive stroke in response to the drive stroke of the piston and a return stroke in response to the return stroke of the piston, a fastener magazine assembly carried by said housing assembly for feeding successive fasteners laterally into the drive track to be driven therefrom by said fastener driving element during the drive stroke thereof, a piston chamber defined at one end of said cylinder and communicating with said drive piston, an air pressure reservoir communicating with said piston chamber, an exhaust path defined in said housing assembly communicating the piston chamber with the atmosphere when the exhaust path is in an opened condition, a pilot pressure operated main valve movable from a normally closed position into an opened position closing the exhaust path and allowing a supply of air under pressure from the air pressure reservoir to be communicated with the piston chamber to initiate and effect the movement of the drive piston and fastener driving element through the fastener drive stroke thereof, said main valve having a first pressure area defining with a portion of said housing assembly a pilot pressure chamber, and a second pressure area in opposing relation to said first pressure area and being exposed to the supply of air under pressure, a feed orifice communicating the air pressure reservoir with the pilot pressure chamber, an actuator mounted for movement with respect to an exhaust port for controlling pressure in the pilot pressure chamber, said actuator being (1) normally disposed in an inoperative position closing the exhaust port such that pressure within said air pressure reservoir may communicate with said pilot pressure chamber via said feed orifice as pilot pressure therein, and (2) movable in response to a manual actuating procedure into an operating position opening the exhaust port and exhausting the pilot pressure in said pilot pressure chamber through the exhaust port to atmosphere, a trigger member mounted with respect to said housing assembly for manual movement from a normal inoperative position to an operative position for moving the actuator to its operating position, a first passage structure between the pilot pressure chamber and the exhaust port, a secondary valve member mounted with respect to said first passage structure so as to be movable between an opened position biased by said air under pressure permitting communication between said pilot pressure chamber and said exhaust port, and a closed position biased by air pressure over the drive piston in said piston chamber preventing communication between said pilot pressure chamber and said exhaust port, and a second passage structure communicating said piston chamber with said secondary valve member such that the air pressure over the drive piston is in communication with said secondary valve member, wherein an operative cycle is initiated upon movement of said trigger member to its operative position which moves said actuator to its operating position exhausting pilot pressure in said pilot pressure chamber and causing said main valve to move to its opened position thereby initiating the fastener drive stroke, wherein a build-up of air pressure over said drive piston occurring in said piston chamber communicates with said secondary valve member to move said secondary valve member to its closed position preventing communication between said pilot pressure chamber and said exhaust port such that pressure within said air pressure reservoir may communicate with said pilot pressure chamber via said feed orifice to increase the pilot pressure in said pilot pressure chamber thereby causing said main valve to move to its closed position, and wherein said secondary valve member is constructed and arranged to move in response to changes in air pressure over said drive piston occurring in said piston chamber to cause said main valve to reciprocate between its opened and closed positions thereby causing said drive piston to move through repeated operating cycles as long as said trigger member is in its operative position.

2. The pneumatically operated fastener driving device according to claim 1, wherein said housing assembly includes a cylindrical portion housing said cylinder and a frame portion extending generally laterally from said cylindrical portion, said frame portion having an annular seat, said main valve including an annular surface which engages said seat in sealing relation when said main valve is in its closed position, said second pressure area being defined as an area extending beyond said annular seating surface and exposed to said air under pressure in said pressure reservoir, when said main valve is in its closed position.

3. The pneumatically operated fastener driving device according to claim 2, wherein at least a portion of said annular surface of said main valve includes a urethane seal member thereon.

4. The pneumatically operated fastener driving device according to claim 3, wherein said main valve and said secondary valve are disposed in a housing unit, said housing unit including:

a valve housing, said main valve being mounted with respect to said valve housing, and a trigger housing coupled to said valve housing, said trigger member being coupled to said trigger housing.

5. The pneumatically operated fastener driving device according to claim 4, wherein said valve housing is coupled to said trigger housing by fasteners and said trigger housing is removably coupled to said frame portion of said housing assembly.

6. The pneumatically operated fastener driving device according to claim 4, wherein said housing unit is constructed and arranged with respect to said frame portion of said housing assembly so as to be removable therefrom as a unit.

7. The pneumatically operated fastener driving device according to claim 1, wherein said feed orifice is sized to control dwell of said piston at a bottom of its stroke.

8. The pneumatically operated fastener driving device according to claim 1, wherein a portion of said first passage structure comprises a restrictive path constructed and arranged to restrict air flow from said pilot pressure chamber to said exhaust port.

9. The pneumatically operated fastener driving device according to claim 1, wherein said secondary valve member is generally cylindrical and has first and second opposing surfaces, said surfaces having substantially equal surface areas.

10. The pneumatically operated fastener driving device according to claim 9, wherein when said secondary valve member is in its closed position a surface area of said first surface exposed to said air under pressure is less than a surface area of said second surface exposed to pressure over said drive piston.

11. The pneumatically operated fastener driving device according to claim 9, wherein an O-ring is disposed about a periphery of said secondary valve member to prevent communication between said first passage structure and said second passage structure.

12. The pneumatically operated fastener driving device according to claim 1, wherein said housing includes a cylindrical portion housing said cylinder and a frame portion extending generally laterally from said cylindrical portion, said main valve and said secondary valve being disposed in a housing unit, said housing unit including a valve housing and a trigger housing coupled to said valve housing, said trigger member being coupled to said trigger housing, said main valve being mounted with respect to said valve housing and said secondary valve member being mounted with respect to said trigger housing, said housing unit being constructed and arranged to be removed from said housing assembly.

13. The pneumatically operated fastener driving device according to claim 1, further comprising a valve disposed in said second passage structure constructed and arranged to restrict air flow in said second passage structure thereby controlling piston dwell at the top of the piston stroke.

14. The pneumatically operated fastener driving device according to claim 13, wherein said valve is a manually moveable needle valve.

15. The pneumatically operated fastener driving device according to claim 14, wherein said housing assembly includes a chamber in communication with said valve, said chamber being constructed and arranged to reduce adjustment sensitivity of said needle valve.

16. The pneumatically operated fastener driving device according to claim 1, further including a spring biasing said actuator to the inoperative position together with said air under pressure, said actuator including a seal member which seals said exhaust port when said actuator is in the inoperative position.

17. The pneumatically operated fastener driving device according to claim 1, further including a spring biasing said main valve upwardly towards its closed position.

18. The pneumatically operated fastener driving device according to claim 1, wherein said main valve is disposed above said one end of said cylinder such that in its closed position, said main valve contacts said one end of said cylinder, and wherein said secondary valve member is disposed generally adjacent said main valve.

19. The pneumatically operated fastener driving device according to claim 18, wherein said housing assembly includes (1) a cap member mounted above said cylinder, said main valve being mounted in said cap member, and (2) a valve module mounted to said cap member, said secondary valve member being mounted in said valve module.

20. The pneumatically operated fastener driving device according to claim 18, further including a spring biasing said main valve downwardly towards its closed position.

21. The pneumatically operated fastener driving device according to claim 1, in combination with a remote actuation unit constructed and arranged to be pneumatically coupled to said housing assembly so as to move said secondary valve member remotely.

22. A pneumatically operated fastener driving device comprising:

a housing assembly including a cylinder therein, said housing assembly defining a fastener drive track, a drive piston slidably sealingly mounted in said cylinder for movement through an operative cycle including a drive stroke and a return stroke, a fastener driving element operatively connected to said piston and mounted in said fastener drive track for movement therein through a drive stroke in response to the drive stroke of the piston and a return stroke in response to the return stroke of the piston, a fastener magazine assembly carried by said housing assembly for feeding successive fasteners laterally into the drive track to be driven therefrom by said fastener driving element during the drive stroke thereof, a piston chamber defined at one end of said cylinder and communicating with said drive piston, an air pressure reservoir communicating with said piston chamber, an exhaust path defined in said housing assembly communicating the piston chamber with the atmosphere when the exhaust path is in an opened condition, a pilot pressure operated main valve movable from a normally closed position into an opened position closing the exhaust path and allowing a supply of air under pressure from the air pressure reservoir to be communicated with the piston chamber to initiate and effect the movement of the drive piston and fastener driving element through the fastener drive stroke thereof, said main valve having a first pressure area defining with a portion of said housing assembly a pilot pressure chamber, and a second pressure area in opposing relation to said first pressure area and being exposed to the supply of air under pressure, a feed orifice communicating the air pressure reservoir with the pilot pressure chamber, an actuator mounted for movement with respect to an exhaust port for controlling pressure in the pilot pressure chamber, said actuator being (1) normally disposed in an inoperative position closing the exhaust port such that pressure within said air pressure reservoir may communicate with said pilot pressure chamber via said feed office as pilot pressure therein, and (2) movable in response to a manual actuating procedure into an operating position opening the exhaust port and exhausting the pilot pressure in said pilot pressure chamber through the exhaust port to atmosphere, a trigger member mounted with respect to said housing assembly for manual movement from a normal inoperative position to an operative position for moving the actuator to its operating position, a first passage structure between the pilot pressure chamber and the exhaust port, a secondary valve member mounted with respect to said first passage structure so as to be movable between an opened position biased by said air under pressure permitting communication between said pilot pressure chamber and said exhaust port, and a closed position biased by air pressure over the drive piston in said piston chamber preventing communication between said pilot pressure chamber and said exhaust port, and a second passage structure communicating said piston chamber with said secondary valve member and with said exhaust path, whereby an operative cycle is initiated upon movement of said trigger member to its operative position which moves said actuator to its operating position exhausting pilot pressure in said pilot pressure chamber and causing said main valve to move to its opened position thereby initiating the fastener drive stroke, air pressure over said drive piston in said piston chamber communicating with said secondary valve member to move said secondary valve member to its closed position preventing communication between said pilot pressure chamber and said exhaust port thereby causing said main valve to move to its closed position, said secondary valve member being constructed and arranged to move in response to changes in air pressure occurring in said piston chamber to cause said main valve to reciprocate thereby causing said drive piston to move through repeated operating cycles as long as said trigger member is in its operative position, and a valve disposed in said second passage structure constructed and arranged to restrict air flow in said second passage structure thereby controlling piston dwell at the top of the piston stroke.

23. The pneumatically operated fastener driving device according to claim 22, wherein said valve is a manually movable needle valve.

24. The pneumatically operated fastener driving device according to claim 23, wherein said housing assembly includes a chamber in communication with said valve, said chamber being constructed and arranged to reduce adjustment sensitivity of said needle valve.

* * * * *